US005407273A

United States Patent [19]

Wilson

[11] Patent Number: 5,407,273

[45] Date of Patent: Apr. 18, 1995

[54] DOUBLE BLADED MIXING INSTRUMENT WITH AXIALLY DISPLACED BLADES

[75] Inventor: Peter Wilson, Paderborn, Germany

[73] Assignee: Gebrueder Loedige, Paderborn, Germany

[21] Appl. No.: 146,093

[22] PCT Filed: May 6, 1992

[86] PCT No.: PCT/DE92/00377

§ 371 Date: Nov. 5, 1993

§ 102(e) Date: Nov. 5, 1993

[87] PCT Pub. No.: WO92/20440

PCT Pub. Date: Nov. 26, 1992

[30] Foreign Application Priority Data

May 11, 1991 [DE] Germany ..... 41 15 496.7

[51] Int. Cl.[6] ..... B01F 7/04

[52] U.S. Cl. ..... 366/313; 366/328

[58] Field of Search ..... 366/64, 66, 67, 96, 366/97, 279, 309–313, 325, 327, 328, 329; 165/94; 416/228, 235

[56] References Cited

U.S. PATENT DOCUMENTS

| | | | |
|---|---|---|---|
| 739,422 | 9/1903 | Jones | 366/312 X |
| 969,016 | 8/1910 | Willmann | 366/311 |
| 1,308,819 | 7/1919 | Taylor | 366/312 X |
| 2,320,976 | 6/1943 | McCartney et al. . | |
| 3,194,504 | 7/1965 | Entrikin | 366/313 X |
| 4,095,307 | 6/1978 | Brubaker | 165/94 X |
| 4,199,266 | 4/1980 | Giusti | 366/312 X |
| 4,552,461 | 11/1985 | Ott et al. | 366/312 X |

FOREIGN PATENT DOCUMENTS

| | | | |
|---|---|---|---|
| 0353576 | 2/1990 | European Pat. Off. . | |
| 0394007 | 10/1990 | European Pat. Off. . | |
| 1001188 | 2/1952 | France | 366/312 |
| 2216011 | 8/1974 | France . | |
| 1122355 | 11/1964 | Germany . | |
| 2739106 | 3/1979 | Germany . | |
| 882662 | 11/1961 | United Kingdom | 366/312 |

OTHER PUBLICATIONS

Ullmanns Encyklopädie der technischen Chemie Band 2, 4. neubearbeitete und erweiterte Auflage, Verfahrenstechnik I (Grundoperationen).

*Primary Examiner*—David A. Scherbel
*Assistant Examiner*—Charles Cooley
*Attorney, Agent, or Firm*—Flynn, Thiel, Boutell & Tanis

[57] ABSTRACT

A mixing instrument for the treatment of solids or individual solid components is attached to a shaft concentrically arranged in a horizontally positioned container. The shaft is mounted in the container in a rotatable fashion. A plurality of mixing instruments are arranged at axial separations on the shaft. The mixing instruments are directed radially towards the inner wall of the container and end at a short separation from the inner wall of the container. The mixing instrument exhibits a first mixing element and a second mixing element which are arranged via an arm behind each other in the direction of rotation. Facing the inner wall of the container, the mixing elements are configured with openings. The openings of the first mixing element are displaced with respect to the openings of the second mixing element. As viewed from the front, the projections of the first mixing element cover the openings of the second mixing element.

4 Claims, 4 Drawing Sheets

DOUBLE BLADED MIXING INSTRUMENT WITH AXIALLY DISPLACED BLADES

FIELD OF THE INVENTION

The invention concerns a mixing instrument for the treatment of solids or individual solid components in a horizontal container with a concentrically arranged shaft mounted in the container in a rotatable fashion and supporting a plurality of axially separated mixing instruments attached to the shaft which are directed radially facing the inner wall of the container and which terminate at a small separation from the inner wall of the container, whereby the mixing instrument itself exhibits an arm and a mixing body comprising at least two plate-shaped mixing elements.

BACKGROUND OF THE INVENTION

A mixing instrument of this type has become known through the German patent 11 22 355.

Mixers having horizontal containers are known for the mixing of pourable materials, in which the material to be mixed is moved with a mixing instrument rotating with the shaft. Plough-share blades are preferentially utilized as mixing instruments and have proven themselves over a wide range of applications. With these mixing instruments it is possible to produce multicomponent mixtures of high mixing quality. Plate-shaped mixing bodies are also known which exhibit sectional areas which are concave and/or convex. Should strongly adhering products be mixed, dried or processed in some other fashion in horizontally arranged mixers, driers or reactors it is known that a product layer can build-up on the inner wall of the container, forming between the inner wall of the container and the front surface of the mixing element (product deposit).

An increased gap between the mixing instrument and the inside wall of the container occurs because the shaft, due to its own weight, exhibits a certain amount of bending if it is rotatably mounted only at the shaft ends. In addition an increased gap between the mixing instrument and the inner wall of the container is also required when the container wall is warmed by means of an energy carrier. The container thereby experiences a certain deformation which changes in dependence on the temperature and the material utilized for the container, the shaft and/or the mixing instrument. It is therefore clear, even in highly precise manufacturing of mixers, driers, and reactors, why an increased gap between the mixing instrument and the inner wall of the container is necessary.

The product deposit which builds up in the gap can harden and continue to build-up so that the energy absorption of the mixing instrument is increased. The deposit can break-off from time to time and thereby, cause a deterioration of the quality of the final mixture. A product deposit of this kind is also overheated in driers or reactors, so that the product itself is destroyed in the vicinity of the inner walls of the container. In reaction processes stoichiometric conditions could thereby change in an uncontrolled fashion.

The known mixing instrument is for these reasons secured in the product region, in a resilient fashion, in order to adjust, by means of a predetermined spring tension, the gap width between the inner wall of the container and the front surface of the mixing instrument. This causes difficulties in construction and is suspectible to failure during manufacturing operations.

A cleaning device for mixing containers or for containers capable of performing motion is known from U.S. Pat. No. 2,320,976 which comprises harrow-like flexible blades. The blades are displaced and attached to rods which move the material to be mixed. The rods rotate and the blades seat, under bias, on the inside surface of the container and thereby scrape product deposit off the inside wall. The blades are seated in a pivotable fashion.

The underlying purpose of the invention is therefore to further improve a mixing instrument of the above mentioned kind in such a manner that the product deposit in the gap between the inner wall of the container and the mixing instrument is largely prevented or is removable in a reliable fashion.

This purpose is achieved in accordance with the invention in that the mixing elements are arranged at least partially behind one another in the circulating direction and exhibit openings on the free end facing the inner wall of the container which are displaced between the first mixing element and the second mixing element and in that the openings, as viewed from the front, are at least partially covered by projections of the second mixing element. The mixing instrument in accordance with the invention thereby has the essential advantage that it allows for the removal of product deposits, built-up in the gap, in narrow paths. The power consumption of the shaft which supports the mixing instruments can be kept small. One projection, adjacent to the openings, is provided for between each individual opening. By means of these projections the product deposit is torn open along a certain axial length. The product deposit strips which still remain are then removed from the projections of the second mixing element. The projections which are arranged, displaced with respect to each other, on the mixing element guarantee that the entire inner wall of the container in the vicinity of the plane of rotation of a mixing instrument is covered so that residual circular-shaped product deposit rings cannot occur. Furthermore, the individual mixing instruments work together in such a manner that the entire axial length of the inner wall of the container is covered. In this fashion, using a simple configuration of the mixing elements on the mixing instrument, the build-up of product deposit is largely prevented and product deposits which occur are easily removed with small expenditures of energy. The wear or abrasion associated with this type of mixing element is reduced.

The individual mixing elements are, in the event of hard product deposits, furthermore subjected to reduced moments and can therefore be produced from materials of reduced strength.

By means of the orbit-shaped removal of the product deposit it is also possible to loosen the longitudinal edges of the product deposit paths in such a manner that it is easier to remove these product deposit tracks from the inner wall of the container by means of the projections of the second mixing element.

In a preferred configuration of the invention a front surface of the mixing element facing the inner wall of the container forms a wedge-shaped gap with the inner container wall. Thereby, as seen in the direction of rotation of the mixing instrument, the rear edge of the mixing element exhibits a larger separation from the inner wall of the container than that of the forward edge. This has the advantage that, depending on the specific behaviour of the product deposit of a given product, an increased or decreased free angle between the mixing instrument and the inner wall of the container can be adjusted. The wedge angle opens oppositely with respect to the rotational direction of the mixing instrument so that no pressing of the loosened product deposit can transpire between the inner wall of the container and the mixing instrument. The energy absorption of the shaft can thereby be kept low.

If, furthermore, the mixing elements exhibit varying distances from the inner wall of the container, it is possible to a greater extent, to take into consideration the specific behaviour of a given product deposit.

In a preferred embodiment, the mixing elements are arranged diagonally with respect to the arm of the mixing instrument in the rotational plane of the mixing instrument so that a defined transporting of the product to be handled in the container can take place. The product exchange in the container and thereby the mixing quality or the yield can be improved with a mixing element configuration of this type.

The projections of the second mixing element are formed in such a manner that they describe the same path of travel as the openings of the first mixing element. The first projections of the first mixing elements stand in similar relationship to the second openings of the second mixing element. If the mixing elements are directed differently, e.g. if the mixing elements do not run precisely parallelly behind another, it is necessary to adjust the openings of the first mixing element to the projections of the second mixing element in such a fashion that they describe the same path of travel on an inside wall of the container.

The mixing instrument in accordance with the invention thereby observes the extensive requirements of mixing technology. With the trailing mixing element it is possible to effect an additional backward mixing and thereby an improved homogeneity of the final product. The energy requirement is reduced compared to conventional mixing elements. This is due to effects which are, per se, known. The emptying out of the product is improved and the granulating characteristics of the inventive mixing instrument are better than those of the known mixing instruments of prior art. Through the change of the angular orientation of the mixing elements with respect to each other, the change of the angle of the leading mixing element, as well as the angle of the mixing elements with respect to the inner wall of the container, a product specific adjustment of the mixing instrument is possible.

Further advantages are derivable from of the description and the accompanying drawing. The previously mentioned characteristics of the invention and those which will be described below can, likewise, each be used individually or with another in arbitrary collective combination. The embodiments mentioned are not to be considered as exhaustive enumeration, rather have only exemplary character.

BRIEF DESCRIPTION OF THE DRAWINGS

The invention is represented in the drawing and is explained in greater detail in the embodiments.

DETAILED DESCRIPTION

Figure 1:
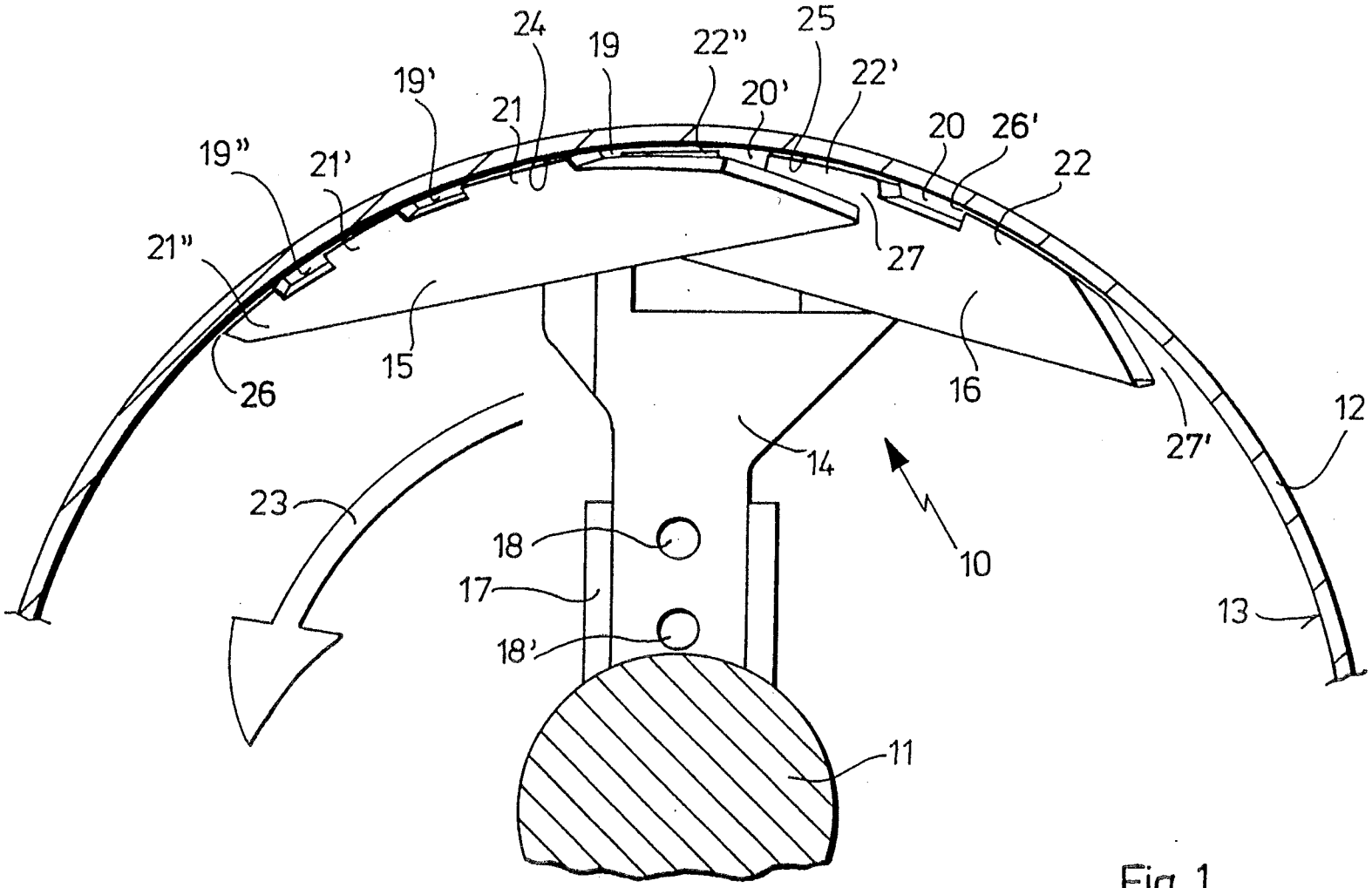
FIG. 1 shows a cross-section through a horizontal container with a concentric shaft and a mixing instrument in accordance with the invention which is attached to the shaft.

The individual figures of the drawing show tile inventive substance in a, partially, largely schematic fashion and are not to be taken to scale. The objects of the individual drawings are, partially, shown enlarged so that their construction can be better illustrated.

FIG. 1 shows a cross-section of a mixing instrument 10 as configured on a shaft 11 in a container 12. The mixing instrument 10 projects radially out from the shaft 11 towards an inner wall of the container 13. The mixing instrument 10 consists of an arm 14, a first mixing element 15, and a second mixing element 16. The arm 14 of the mixing instrument 10 is held in a pocket 17 which is attached to the shaft 11 in a rotationally secure fashion. The arm 14 is attached in the pocket 17 with the assistance of attaching means which reach into bores 18, 18'. The first mixing element 15 exhibits first openings 19, 19', 19'' which are displaced relative to the second openings 20, 20' of the second mixing element. First projections 21, 21', 21'' border on and project beyond the first openings 19, 19', 19'' Second projections 22, 22', 22'' are provided for on the second mixing element 16, the second projections bordering on the second openings 20, 20'. The openings 19, 19', 19'' and 20, 20' are displaced with respect to each other in such a fashion, that with the mixing elements 15, 16 arranged behind each other as seen in the direction of rotation, one opening 19 corresponds to each projection 22 of the second mixing element 16. The mixing instrument 10 moves along the inner wall of the container 13 in the direction of the arrow 23. A first gap 24 is formed between the first mixing element 15 and the inner wall of the container 13 and a second gap 25 is situated between the second mixing element 16 and the inner wall of the container 13. The mixing elements 15, 16 are, in FIG. 1 arranged behind one another at an angle with respect to arm 13 in such a fashion that one first opening 19, 19', 19'' functions together with each second projection 22, 22', 22''.

The front surface of the mixing elements 15, 16 facing the inner wall 13 forms a wedge-shaped gap 27, 27' with the inner wall 13 at a rear end of the mixing element 15, 16. The first mixing element 15 exhibits a first separation 26 from the inner wall 13 which can be different from a second separation 26' of the second mixing element 16 from the inner wall 13.

Figure 2:
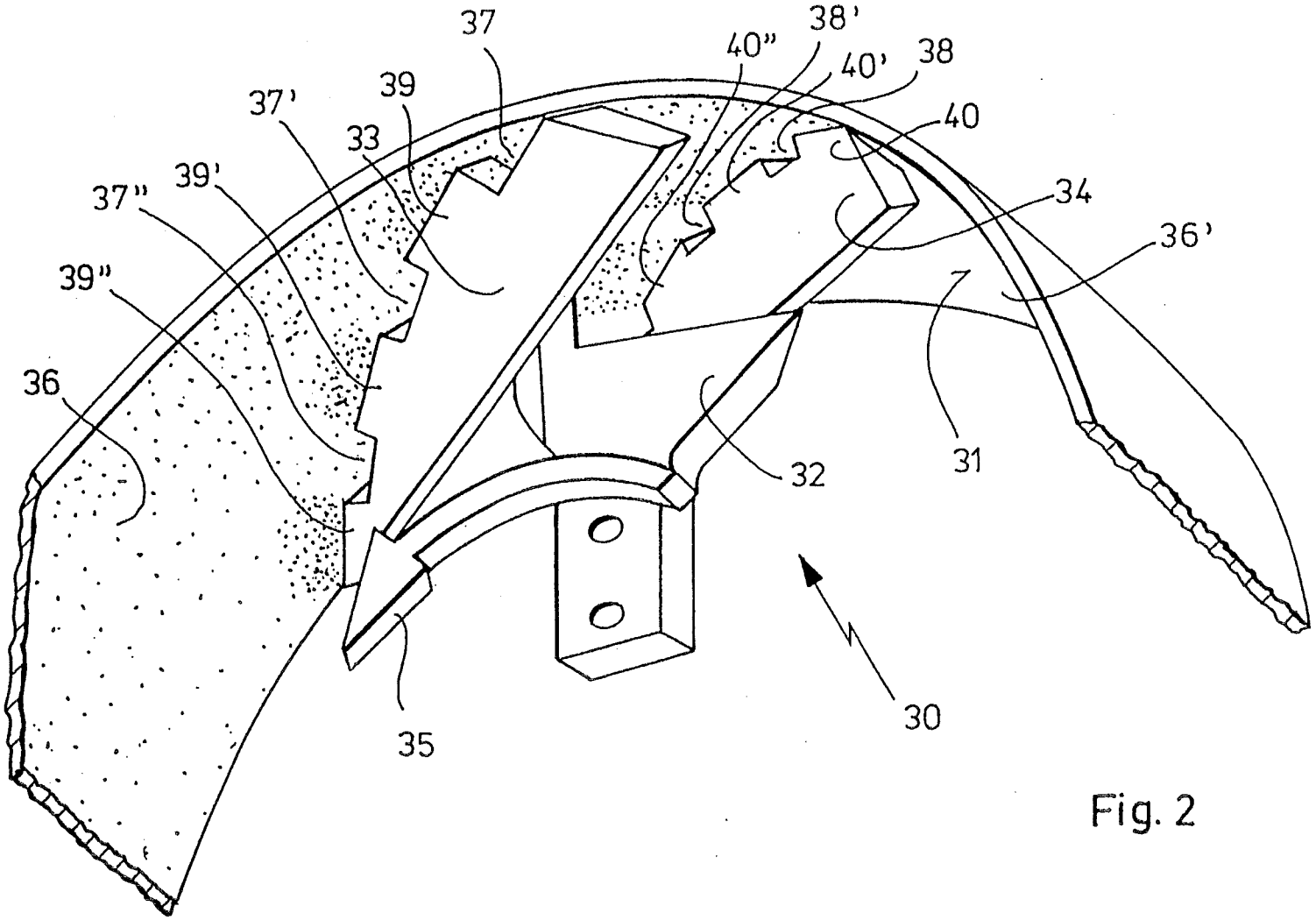
FIG. 2 shows a prospective view of an inventive mixing instrument with an accompanying section of container.

FIG. 2 shows a perspective view of a mixing instrument 30 as it is arranged on the inner wall of a container 31. For reasons of clarity and conceptional simplicity only one section of the container is shown and the shaft upon which the mixing instrument 30 is attached is not drawn in the figure.

The mixing instrument 30 exhibits, on an arm 32, a first mixing element 33 and a second mixing element 34. The mixing instrument 30 rotates in the direction of the arrow 35 in a circular path along the inner wall of the container 31.

A product deposit on the inner wall of the container 31 is indicated with 36 and is schematically shown with dots of varying density. 36' indicates an inner wall of the container 31 which is free of product deposit. First openings 37, 37', 37'' are provided for on the first mixing element 33 and second openings 38, 38' are provided for on the second mixing element 34. The first and the second openings 37, 37', 37'', 38, 38' are configured in such a fashion that they function together with a first projection 39, 39' 39'' and a second projection 40, 40', 40'' of the first and the second mixing elements 33, 34. The figure schematically shows how the product deposit 36 is removed, along paths, from the inner wall of the container 31 by means of the displaced first and second projections 39, 39', 39'' and 40, 40', 40''.

Figure 3:
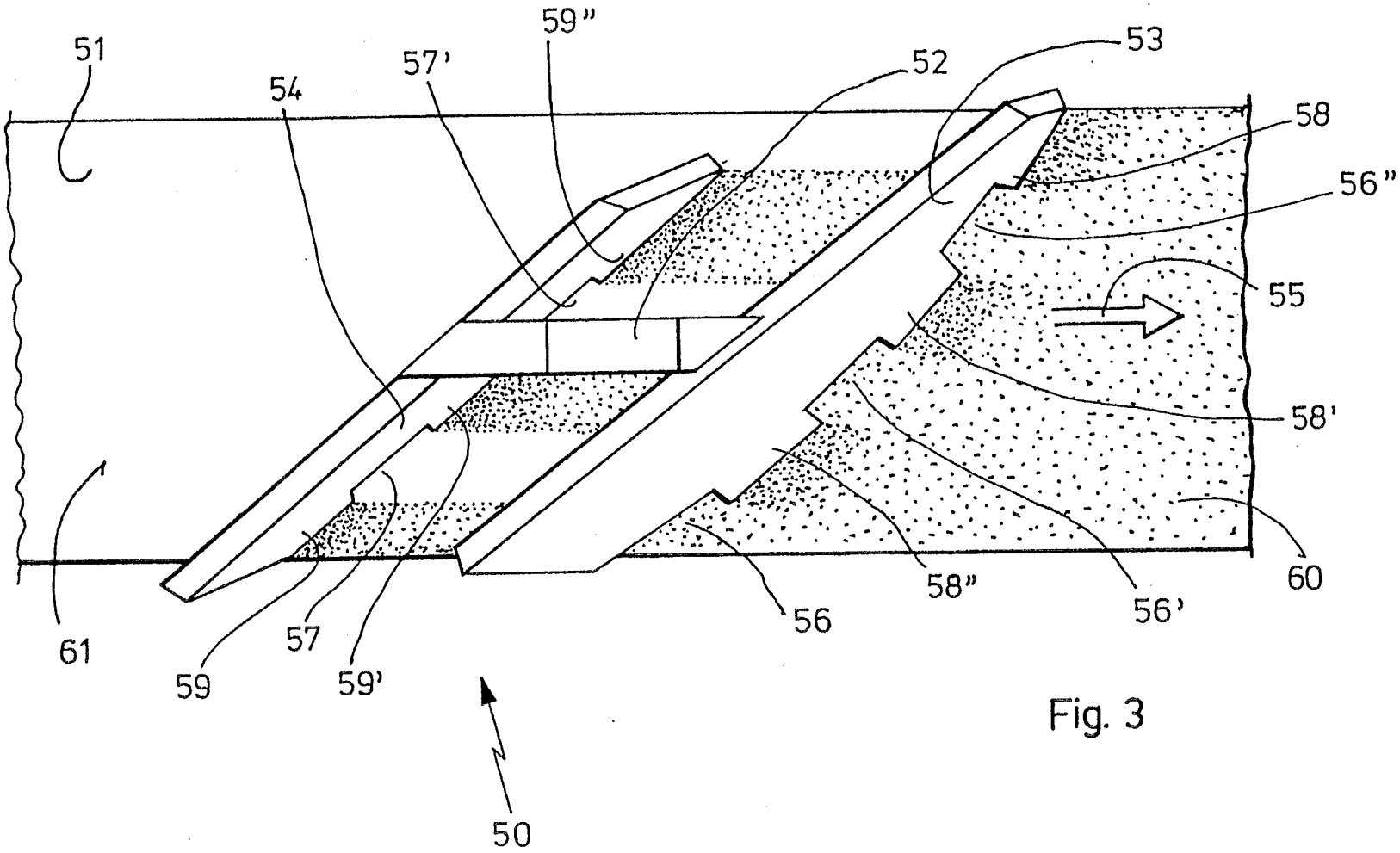
FIG. 3 shows a flattened-out view of a section of the container and of the inventive mixing instrument corresponding to this container section.

FIG. 3 shows a mixing instrument 50 as arranged with respect to a flattened-out representation of container section 51. An arm 52 of the mixing instrument 50 is shown without shaft. A first mixing element 53 and a second mixing element 54 are attached to the arm 52. The mixing elements 53, 54 pass over the inner side of the container section 51 in the direction of the arrow 55. The first openings 56, 56', 56'' of the first mixing element 53 and the second openings 57, 57' of the second mixing element 54 are arranged displaced with respect to another. A product deposit 60 on the inner side of the container section 51, indicated by the dots, is removed in short axial paths by means of the first projections 58, 58', 58'' and second projections 59, 59', 59''. The deposit-free innerside of the container section 51 is represented in the figure with 61.

Figure 4:
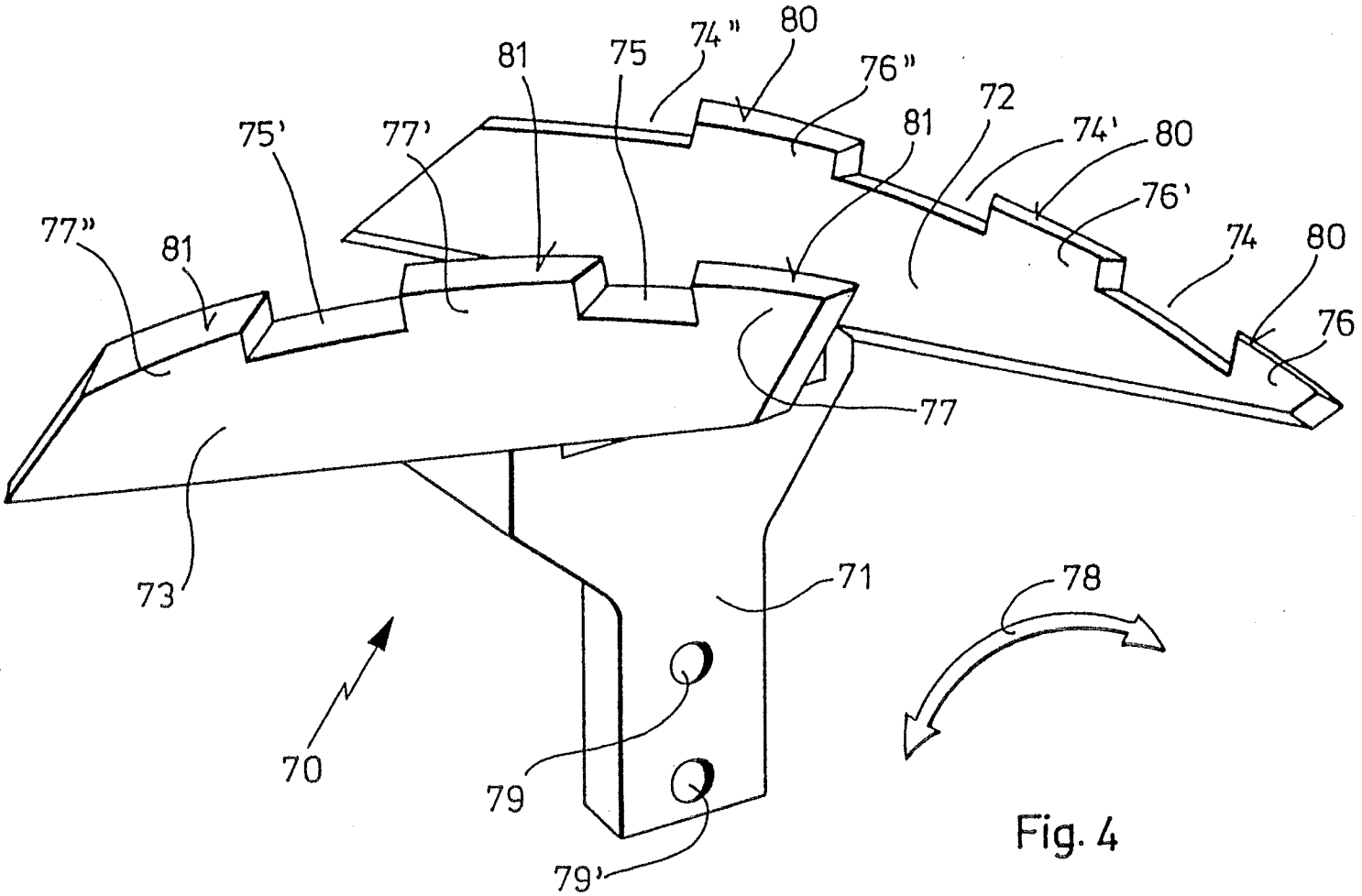
FIG. 4 shows an over all view of a mixing instrument in accordance with the invention as attachable to a shaft in a horizontal container.

FIG. 4 shows a mixing instrument 70 which is attachable to a shaft mounted in a horizontal container. The mixing instrument 70 consists of an arm 71 and a first mixing element 72 as well as a second mixing element 73. The second mixing element 73 is arranged behind the first mixing element 72. First openings 74, 74', 74'' are provided for on the first mixing element 72 which, when the mixing instrument 70 is installed, face the inner wall of the container. Second openings 75, 75' are likewise provided for on the second mixing element 73, which are displaced relative to the first openings 74, 74', 74'' of the first mixing element 72. The second openings 75, 75' are covered by the first projections 76, 76', 76'', and second projections 77, 77', 77'' cover the first openings 74, 74', 74'' of the first mixing element 72. The mixing instrument 70 can move in the direction of the arrow 78 when it is rotated by an attached shaft. The mixing instrument 70 can be attached to a shaft not shown in the figure via bores 79, 79'.

Front surfaces 80, 81 of the first and the second mixing elements 72, 73 can form a wedge-shaped gap, opening in a direction opposite to the direction of motion, with an adjacent inner wall of the container. The mixing elements 72, 73 are arranged diagonally to the plane of rotation.

The front surfaces 80, 81 of the mixing elements 72, 73 can be profiled in varying manners along the entire axial length of the mixer. In this fashion, in an embodiment, the openings and projections are rectangular-shaped. Varying multiple-sided forms are conceivable for the openings as well as for the projections.

I claim:

1. An improved mixing instrument for the treatment of solids, liquid solid mixtures, melts, highly viscous fluids and individual solid components, said mixing instrument comprising:

a horizontal container;

a shaft which is concentrically configured and rotatably mounted in said container; and a plurality of mixing instruments attached to said shaft and separated from each other along an axial direction of said shaft, said mixing instruments being radially directed and facing an inner wall of said container and ending at a small separation from said inner wall, each mixing instrument comprising an arm and a mixing body integrally attached to an end of said arm, said mixing body comprising at least a first and a second mixing element, the improvement wherein at least said first mixing element and said second mixing element each includes first and second projections extending from an end thereof towards said inner wall, said first and second mixing elements being arranged, as viewed in a direction of rotation of the shaft, behind one another with said projections defining openings at free ends facing said inner wall, said openings in said first mixing element being axially displaced relative to said openings in said second mixing element, and said openings in said first mixing element, as viewed from a front of said second mixing element, being at least partially covered by said projections of said second mixing element.

2. The mixing instrument of claim 1, wherein a front surface of at least one of said first and said second mixing elements facing said inner wall of said container forms a wedge-shaped gap with said inner wall which tapers away from said inner wall at a rear end of said mixing element.

3. The mixing instrument of claim 1, wherein at least one of the first and the second mixing elements exhibit different separations from the inner wall of the container.

4. The mixing instrument of claim 1, wherein at least one of the first and the second mixing elements is arranged diagonally to a plane of rotation.

* * * * *